US006360461B1

(12) United States Patent
Blume et al.

(10) Patent No.: US 6,360,461 B1
(45) Date of Patent: Mar. 26, 2002

(54) ELECTRIC PRESSING IRON AND METHOD OF MANUFACTURING AN ELECTRIC PRESSING IRON

(75) Inventors: Friedrich Blume, Schwalbach/Ts. (DE); Antonio Rebordosa Rius, Barcelona (ES); Miguel Vazquez Palma, Barcelona (ES); Juan Carlos Coronado Sanz, Barcelona (ES)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/489,054

(22) Filed: Jan. 21, 2000

(30) Foreign Application Priority Data

Jan. 22, 1999 (EP) ..... 99101175

(51) Int. Cl.[7] ..... D06F 75/38
(52) U.S. Cl. ..... 38/93
(58) Field of Search ..... 38/93; 29/900, 29/904

(56) References Cited

U.S. PATENT DOCUMENTS 2,298,113 A * 10/1942 Ely
5,025,578 A * 6/1991 Firatli et al. ..... 38/93
5,105,525 A * 4/1992 Firatli et al.
5,619,813 A * 4/1997 Forest et al. ..... 38/93

FOREIGN PATENT DOCUMENTS

| | | |
|---|---|---|
| DE | 36 44 211 | 8/1987 |
| EP | 0 711 863 | 5/1996 |
| EP | 0 844 327 | 5/1998 |

* cited by examiner

*Primary Examiner*—Ismael Izaguirre
(74) *Attorney, Agent, or Firm*—Fish & Richardson P.C.

(57) ABSTRACT

The invention is directed to an electric pressing iron having a pressing iron body portion made of silicon containing cast aluminum and equipped with an electric heating unit and with a plate-shaped soleplate made of low-silicon aluminum and secured to the pressing iron body portion in a heat-conducting relationship thereto. In order to utilize the advantages of good formability and thermal conductivity afforded by the aluminum soleplate while at the same time obtaining high corrosion and wear resistance and excellent hardness characteristics with reasonable economy of manufacture, it is proposed providing the soleplate with a nickel and/or chromium containing coating applied by electrodeposition to the soleplate to a thickness of more than 40 $\mu$m, said coating being structured to increase progressively in hardness outwardly towards the ironing side of the aluminum soleplate. Furthermore, the invention is directed to a method of manufacturing such an electric pressing iron.

18 Claims, 1 Drawing Sheet

ELECTRIC PRESSING IRON AND METHOD OF MANUFACTURING AN ELECTRIC PRESSING IRON

BACKGROUND OF THE INVENTION

1. Field of the Invention

This invention relates to an electric pressing iron having a pressing iron body portion made of silicon containing cast aluminum and equipped with an electric heating unit and with a plate-shaped soleplate made of low-silicon aluminum and secured to the pressing iron body portion in a heat-conducting relationship thereto, and to a method of manufacturing an electric pressing iron.

2. Background Information

From U.S. Pat. No. 2,846,793 there is known an electric pressing iron having an aluminum body portion to which is secured a pressing iron shoe made of carbon steel. The pressing iron shoe is coated with a nickel layer and a chromium layer. It is a disadvantage that nickel-plated and chromium-plated carbon steel fails to meet the requirements imposed on the corrosion resistance of a steam pressing iron, particularly in its steam discharge ports.

Using a soleplate made of steel is an obvious solution because of its relatively high basic hardness and low coefficient of thermal expansion determining the soleplate's tendency to deform under the action of heat from the pressing iron. There is less likelihood, therefore, of cracks forming in a steel soleplate's coating. On the other hand, a pressing iron with a steel soleplate has a higher power loss because, compared to aluminum, it is a poorer conductor of heat. Formability and blankability are also less good. This disadvantage is all the more aggravated by the increasing demands placed on precisely formed recesses with predefined rounded radii and the formation of holes in the soleplate.

An approach is also known which includes the step of coating the soleplate of an electric pressing iron with nickel using a plasma or flame spraying method, thereby improving the soleplate's scratch resistance. A disadvantage of this type of coating is that it can be produced only at great outlay and generally requires mechanical pretreatment and aftertreatment by blast grinding and drag grinding in order to achieve adequate adhesion of the coating on the one hand and the required final smoothness on the other hand.

From EP 0 754 256 there is already known an electric pressing iron of the type initially referred to. This pressing iron has a body portion made of silicon containing cast aluminum, being heat-conductively bonded to a plate-shaped soleplate made of low-silicon aluminum. In this case the soleplate is anodized, as the result of which the surface of the soleplate is transformed to an aluminum oxide layer. This type of surface treatment has turned out, however; to come up against its limits as regards the level of scratch resistance and hardness that can be achieved by justifiable means.

SUMMARY OF THE INVENTION

It is an object of the present invention, therefore, to provide an electric pressing iron and a method of manufacturing an electric pressing iron of the type initially referred to, which affords the advantages of an aluminum soleplate's good formability and thermal conductivity while at the same time satisfying requirements such as corrosion resistance, wear resistance and excellent hardness with reasonable economy of production.

As regards to the electric pressing iron, this object is accomplished in various embodiments of the invention.

According to the present invention, a soleplate made of low-silicon aluminum is used. It has proven possible to produce a coating on low-silicon aluminum by an electroplating process with reduced pretreatment requirements while at the same time achieving an optimal quality of coating. Unlike the autocatalytic chemical electroplating process which operates without external current, the present invention utilizes external current (applied to the electrodes in the electrolyte bath) to deposit in an electrolytic process metals or their alloys on the aluminum soleplate. Nickel and/or chromium, for example, provide adequate corrosion resistance as well as high hardness. A coating thickness of more than 40 $\mu$m is required to prevent indentation of a naturally hard coating on the relatively soft aluminum. Advantageously, provision is made for the hardness to increase in steps or continuously from the aluminum soleplate to the outer side of the coating. It is only as the result of this outwardly increasing hardness gradient on the soleplate that each successive outer lying layer of the coating is able to display sufficient load carrying capability and partial surface compressability, ultimately enabling an excellent level of hardness and scratch resistance without the formation of any cracks in the coating.

In some embodiments, the coating is advantageously formed from one or several single layers containing pure nickel, nickel alloys with sulfur, phosphorus, cobalt, iron, sulfur and iron and/or tungsten, and/or chromium (in particular as the final coat). On account of the relatively small economic outlay involved in the deposition (using external current) of nickel or alloys it is an advantage to form a major part of the coating with these materials. Unlike pure nickel, nickel compounds or nickel alloys with sulfur, with phosphorus, with iron, together with iron, with sulfur and iron or with tungsten permit the production of layers with varying higher degrees of hardness at likewise varying corrosion resistance so that a coating structure with increasing degrees of hardness can be economically manufactured on the basis ofjust one nickel compound. It will be understood that the nickel compounds and nickel alloys referred to are presented only in terms of their main constituents and not in terms of their chemical compound. Thus, for example, the nickel-sulfur alloy used here is a nickel alloy with nickel sulfide.

In some embodiments, provision is made advantageously for a first layer of pure nickel and a second layer of a nickel alloy. Pure nickel, that is, nickel without any admixture of, for example, sulfur or phosphorus, displays high ductility as well as slightly higher hardness compared to an aluminum surface so that the tendency to form cracks under load is prevented. The initial hardness of the aluminum surface, which is typically less than or equal to 50 dphn, is increased by the pure nickel layer to more than 150 dphn. The difference in hardness between the two layers is less than or in the range of 200 dphn so that the pure nickel layer forms the first layer with load-bearing capability. The preferred choice for the second layer is a nickel-sulfur alloy, whereby a higher resistance to corrosion due to the formation of potential is achieved because, compared to pure nickel, this metal is less noble in terms of its corrosion potential. Furthermore, this nickel-sulfur alloy enables a final hardness of more than or equal to 400 dphn to be obtained so that the difference in hardness between pure nickel and nickel/sulfur is also adequate. A third layer of chromium further increases the overall hardness characteristic of the coating to approximately more than or equal to 800 dphn, resulting in excellent resistance to scratching. Having the chromium layer as the outermost layer is also an advantage in that it suffers no discoloration or tarnishing under the action of heat, which on pressing irons can be as high as 300° C. Furthermore, the chromium layer also increases protection.

It is advantageous for the coating to be structured in its degree of hardness so that the first layer has a hardness of at least more than or equal to 150 dphn, the second layer a hardness of more than or equal to 350 dphn, and a third or outermost layer on the soleplate a hardness of more than or equal to 550 dphn, particularly more than 700 dphn. This progressively increasing hardness in the coating structure is necessary because the electroplating is performed on low hardness aluminum resulting in a layer structure which, on the whole, has adequate load carrying capability. Experience has shown that, in order to achieve excellent resistance to scratching, the differences in hardness between adjoining layers are not allowed to exceed certain limits so as to prevent the formation of cracks under thermal load. Ideally, the difference in hardness between the aluminum base material of the soleplate and the first layer should not exceed 250 dphn, the difference in hardness between the first and the second sub-layer should not exceed 350 dphn, and the difference in hardness between the second and third layer should not exceed 500 dphn in order to obtain a structure with good load carrying capability and zero tendency to form cracks. The first layer is constructed to provide only a moderate increase in hardness and is mainly optimized with a view to ductility so that any cracks which form nevertheless are certain not to extend through to the aluminum and possibly cause corrosion. The second layer is important for increasing the resistance to corrosion and for leveling the surface. The need for mechanical pretreatment and aftertreatment, such as is necessary with plasma spraying or anodizing, is thereby obviated. The outermost layer has to retain its high-quality appearance and be as hard as possible. This explains why the first layer is less hard but the outermost layer very hard. Some coatings make do with fewer different layers, uniting the above characteristics to a certain degree.

Advantageously, the outermost or third layer of the coating is a chromium layer with a hardness of between 700 dphn and 1,100 dphn. The soleplate is thus able to cope with the greatest scratch loads during ironing, including under the action of heat.

Advantageously, the coating comprises a first layer with a thickness of 10 to 70 $\mu$m, particularly 50 $\mu$m, a second layer likewise with a thickness of 10 to 70 $\mu$m, particularly 50 $\mu$m, and a third layer with a thickness of 10 to 50 $\mu$m. Ideally, the first and second layer each are 50 $\mu$m thick, and the third layer is 20 $\mu$m thick. With aluminum having a coefficient of thermal expansion of around $24\times10^{-6}$/K, nickel a coefficient of thermal expansion of around $13\times10^{-6}$/K, and chromium a coefficient of thermal expansion of around $7\times10^{-6}$/K, the layer structure of the coating is designed with an outwardly decreasing coefficient of thermal expansion. The elongation at rupture values of the coating metals increase in the direction of the base material (aluminum) so that thermal stresses due to a bimetal effect do not produce any cracks, particularly in the first nickel layer. The layer thicknesses are optimized accordingly to ensure maximal durability of the electrodeposits. In view of the fact that coatings applied by electroplating using external current are generally thicker at the edges, for example, than in the central zones of uninterrupted surfaces, assuming that no measures are taken to optimize the primary current distribution in the interest of a uniform layer thickness, the figures quoted for the layer thicknesses apply to a central planar section of the soleplate that is not directly contiguous to any holes, edges and recesses, where present.

In an advantageous further aspect of the present invention, the coating has an overall thickness of more than 60 $\mu$m. In contrast to heretofore coated soleplates made of steel, for which a coating thickness of less than 40 $\mu$m has been used, a soleplate coating which is at least 40 $\mu$m thick or, better still, at least 60 or 80 $\mu$m thick, ensures that the high requirements imposed on an electrodeposit on aluminum are met.

The object of the present invention with regard to the method is accomplished in various embodiments of the invention.

In an advantageous further aspect of some embodiments of the invention, the soleplate to be coated with nickel by electrodeposition is immersed in an electrolyte bath with external current applied to its electrodes, wherein a screen made of a non-conductive material as, for example, plastic, is arranged in such a way that the deposited layer is uniformly distributed in its thickness over the surface of the soleplate.

For similar reasons, for electrodeposition of a chromium layer the soleplate is immersed in an electrolyte bath in such a way that a shaped anode (conforming to the shape of the soleplate) is positioned in front of the soleplate, thus resulting in the deposition of a layer having an essentially homogeneous thickness.

Further objects, advantages, features and application possibilities of the present invention will become apparent from the subsequent description of several embodiments and the accompanying drawing. It will be understood that any single feature and any meaningful combination of single features described and/or represented by illustration form the subject-matter of the present invention, irrespective of their summary in the patent claims or their back reference.

BRIEF DESCRIPTION OF THE DRAWINGS

In the drawing,

FIG. 1 shows a detail, in section, of the lower area of a steam iron, meaning that area of the steam iron nearest to the material being ironed when in use. There is a pressing iron body portion 1, which for enhanced casting and demolding is made of silicon containing cast aluminum. An electric resistance heating unit 2 is integrally cast in the pressing iron body portion. In addition, recesses and channels for the steam generating chamber and the conveyance of steam are formed in the body portion (not shown in FIG. 1). The soleplate 3 is secured to the body portion 1 in good heat conducting relationship thereto. The bond with its good heat conducting properties is preferably established by means of a silicone adhesive 4. The soleplate 3 consists of low-silicon aluminum, which is advantageous not only in respect of its low weight, its good blankability and formability and good thermal conductivity, but also because of its low silicon content which forms a good basis for a coating which is electrodeposited using external current. The electrolytic process of depositing the coating 5 results in the soleplate being coated on both sides, deposition being greater on the outer side of the soleplate, meaning the side facing the material being ironed when in use, than on the reverse side thanks to the arrangement on the plating racks in the electrolyte bath. Basically, however, the inner side of the soleplate is also sufficiently protected from corrosion by this electrodeposit 5. This is of importance particularly because cavities are provided between the pressing iron body portion and the soleplate to distribute the steam, whereby the inner side of the soleplate is directly exposed to the steam.

Figure 1:
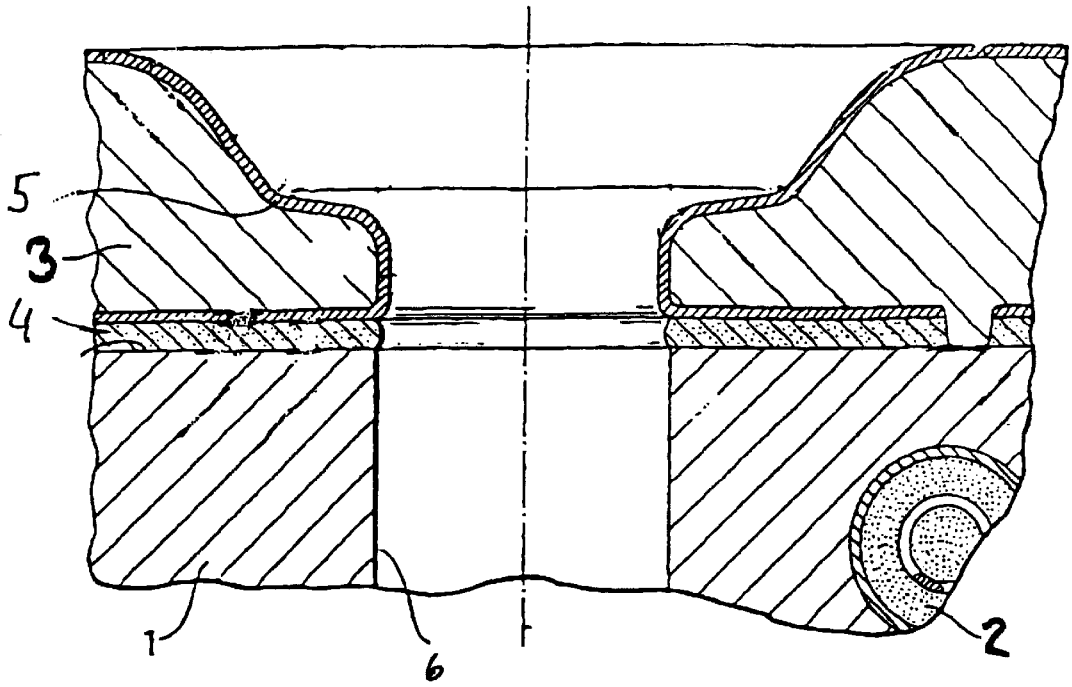
FIG. 1 is a sectional view of the pressing iron body portion with the soleplate secured thereto in the area of a steam discharge port.

The detail of the cross-sectional view of FIG. 1 shows the soleplate 3 and the pressing iron body portion 1 in the area of a steam discharge port 6, the radii embossed in the aluminum soleplate 3 in the area of the steam discharge port being designed in such a way as to ensure a good sliding action of the soleplate over buttons, zippers and other parts of the material being ironed.

Figure 2:
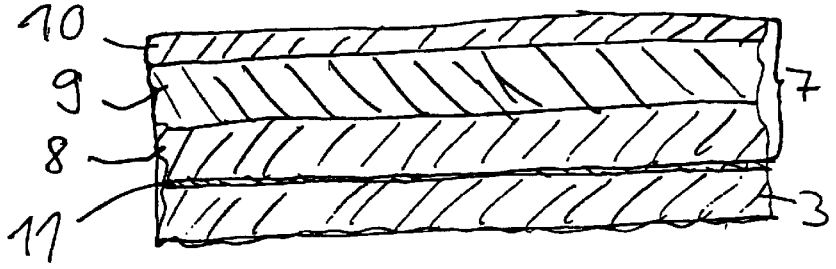
FIG. 2 is a sectional view of a detail of the soleplate with the coating applied.

FIG. 2 shows a preferred embodiment of the electric pressing iron. A detail of the soleplate 3 having a coating 7 applied to it by electrodeposition is presented in both its lateral and downward extension toward the pressing iron body portion 1.

According to this embodiment the coating 7 is composed of a first layer 8 of pure nickel, which displays high ductility in order to prevent the formation of cracks. Ideally, this first layer is deposited in a thickness of 40 to 60 $\mu$m. The first layer increases the hardness of the soleplate surface to around 150 to 200 dphn.

A so-called bright or semi-bright nickel layer is applied by electrodeposition with external current as the second layer 9 on the layer of pure nickel. The bright nickel contains not only nickel but also an admixture of 0.05% sulfur, so that the less noble bright nickel results in a higher potential difference than the first layer, thus improving the protection from corrosion. The bright nickel is deposited likewise in a thickness of around 40 to 60 $\mu$m so that the surface hardness of the soleplate is increased for the second time to around 350 to 500 dphn. Certain organic additives are admixed to achieve the requisite semi-bright effect.

A hard chromium layer is applied by electrodeposition with external current to the second layer 9 as the third and preferably outermost layer 10. The surface hardness of the coated soleplate 3 is thus increased for the third time to around 700 or 800 to 1,100 dphn, particularly to around 900 dphn. This provides the soleplate with the desired characteristics of being highly resistant to scratches and mechanical impact. Furthermore, chromium differs from nickel in that it does not turn notably yellow under the action of heat, which is a feature of importance on pressing irons. Up to the maximal ironing temperature of 300° C., chromium does not tarnish. Considering that hard chromium involves a greater economic outlay than nickel, it has proven sufficient, thanks to the preceding layer structure of coating 7, to deposit the hard chromium in a thickness of just 10 to 30 $\mu$m.

The coating of this embodiment of FIG. 2 has a total average thickness of around 120 $\mu$m, a thickness of 40 or better still 60 $\mu$m being regarded the critical lower limit for the coating 7. The strength or thickness of the coating or individual layers depends not only on the base material to be subject to electroplating, namely aluminum, but also on the process employed, namely the electrolytic process of depositing the coating with the application of external current in an electrolyte bath.

In an alternative embodiment the metallic coating of the second layer, a nickel-sulfur alloy, is replaced by a nickel-iron alloy or a nickel-iron-sulfur alloy. The admixture of iron leads, particularly on a subsequent annealing operation or under thermal loading such as can occur through normal use of the pressing iron, to a tending increase of strength so that a higher level of final hardness is reached than is the case with certain nickel alloys whose hardness tends to decrease slightly from their initial hardness under thermal load. The hardness values quoted here refer, therefore, at least to the pressing iron in its new condition. This fact also underlines the importance of achieving a high level of final hardness that still displays excellent scratch and abrasion properties under thermal load. The approach of increasing the final hardness of an electroplated soleplate by a nickel-iron-sulfur compound/alloy can be in particular the subject of a separate patent application. The deposition of nickel-iron(-sulfur) as a single coating or in combination with other layers such as suggested above is possible with this approach. Bright nickel-iron alloys have an iron content of around 5 to 25% and, optionally, a sulfur content of around 0.02 to 0.05%. If, for example, an initial hardness of 500 dphn is achieved with a nickel-iron alloy, a subsequent heat load of around 250° C. will result in a final hardness of up to around 650 dphn. This effect is particularly advantageous when used on pressing irons.

In a further alternative embodiment, a coating structure is composed of layers having one or several of the following metallic coatings. As its first functional layer the coating includes a layer of pure nickel for the reasons previously mentioned. On this first layer is deposited a nickel-cobalt or nickel-cobalt-sulfate layer. The cobalt produces an increase in the hardness of the nickel deposit, with the possibility for the incorporation rate of the cobalt and the resulting increase in hardness to be continuously increased by means of the current density in the electrolyte bath. Furthermore, this does not adversely affect ductility. A further sulfur-nickel layer and/or a nickel-iron or nickel-iron-sulfur layer is then electrodeposited on the soleplate 3. As a further or alternative layer a nickel-phosphorus and/or a nickel/tungsten layer is/are deposited on the soleplate. These nickel additives are both thermostable and hardness-enhancing so that the properties required of the soleplate are further improved. In this embodiment, too, a subsequent temperature load will tend to result advantageously in an increase of the alloy's hardness. For example, a soleplate coated with phosphorus-nickel or tungsten-nickel can be increased in hardness from 600 dphn to 900 dphn by a 12-hour annealing operation at 250° C. Alternatively, this annealing operation can be omitted and be left to take place during normal use of the pressing iron. The coating in accordance with this alternative embodiment thus includes a layer based on a nickel alloy which undergoes posthardening under the action of heat.

The coating includes one or several layers whose hardness rises in outward direction continuously (within a layer, for example) and/or in steps, the first coating on the aluminum displaying high ductility and high elongation at rupture so that any cracking of the subsequently applied harder and more brittle layers is unable to extend as far as the aluminum and be potentially conducive to corrosion. These requirements are met by pure nickel without sulfur and phosphorus alloy constituents. The function of the second or middle layer(s) lies in a further, preferably thermostable increase in hardness and a high leveling and a brightening effect to the desired degree that eliminates the need for mechanical pretreatment and aftertreatment, thus contributing to an economical process. The function of the final or outermost or third layer consists above all of achieving a yet further increase in hardness while maintaining a high quality of appearance. All or most layer constituents also have a corrosion-reducing effect.

It will be appreciated that in a further alternative embodiment the coating comprises just a single layer, preferably a nickel alloy.

In a further variation a coating is formed containing at least one or several of the previously mentioned alloys or metallic coatings.

There now follows a description of the method for manufacturing an electric pressing iron, in particular the method for manufacturing the soleplate.

The soleplate consists of a wrought aluminum alloy in the form of a rolled plate, particularly of the aluminum-manganese-magnesium (AlMg4, 5 Mn), aluminum-magnesium (AlMg3), aluminumcopper-magnesium (AlCuMg1) types, etc. Experience has shown that in the electrodeposition of coating metals using external current, the depositions are of higher quality if the rolled aluminum plate is practically free of silicon or low in silicon, as in these cases. The soleplate includes steam discharge ports provided in recesses of predetermined radii. Furthermore, the soleplate includes steam ducts with defined radii leading to the otherwise plane surface of the aluminum soleplate. As an option, the outer edge of the soleplate may be bent upwardly at a defined angle, for example, 35° towards the side facing away from the ironing surface. These process steps are performed by the usual forming methods, resulting in a soleplate structure known from the applicant's other patent applications.

Prior to applying metallic coatings to the aluminum substrate of the soleplate by electrodeposition using external current, the soleplate is subjected to the cleaning and pretreatment steps commonly used in electroplating processes. One of the pretreatment steps considered to be among the most important ones is to immerse the cleaned soleplate in a zincate solution. In addition to zinc, the zincate pickle contains a number of other metals as, for example, nickel, copper and iron, etc., as well as hydroxides and cyanides. On the one hand they cause slight aluminum erosion and on the other hand they produce an adhesive layer with the alloy metals of this solution as a result of charge exchange. This zincate pickle has a final thickness of less than 0.5 μm and is designated by reference numeral 11 in FIG. 2. The zincate pickle increases the adhesion of all the subsequently applied metal layers 8, 9, 10 of the coating 7.

Cleaning steps, rinsing steps and other process steps usual in electroplating are performed prior to, subsequent to and between the individual process steps described which are regarded here as particularly essential. To apply the pure nickel layer the aluminum soleplate is then immersed in an electrolyte bath in which the applied current flows between the anode and the cathode. In contrast to metal deposits produced purely chemically without the application of external current, an external current is applied to the electrodes of the electrolyte bath for these and the subsequent metal deposits in order to cause metal to deposit on the soleplate. A relatively uniform rate of deposition of the pure nickel is achieved by means of a nonconductive plastic screen placed in front of each soleplate in the electrolyte bath during the deposition process.

As the next essential process step the thus pretreated soleplate is immersed in a bright nickel bath, preferably with a sulfur containing nickel alloy, this procedure being approximately identical to the previous one using likewise a screen. Current densities are controlled so that each of the two nickel layers is deposited in a thickness of around 50 μm. Organic additives as, for example, saccharin or chlorinated ethylsulfuric acids (aliphatic or aromatic), are added to the bright nickel in order to create a predefined semi-bright effect.

Finally, the soleplate thus coated is immersed in a hard chromium electrolyte bath in which an external current is likewise applied to the electrodes for the metal deposition. The time and the current intensity at the electrodes are controlled so that hard chromium is deposited in a layer thickness of around 20 μm. Shaped anodes, meaning anodes conformed to the shape of the soleplate, are used to produce a uniformly applied layer.

Unlike other known methods of coating soleplates, this electrodeposition of metallic coatings using external current applied to the electrodes equips both sides of the aluminum soleplate with the metallic coatings, whereby the inner side of the soleplate facing the pressing iron body portion is covered with a significantly thinner metallic coating because the irons are suspended accordingly in the electrolyte baths (for preferred deposition on the outer side of the soleplate).

As an alternative to the zincate alloy used it is possible to use a tin alloy in accordance with the alkaline tin IV process.

What is claimed is:

1. An electric pressing iron body portion (1) made of silicon containing cast aluminum and equipped with an electric heating unit (2) and with a plate shaped soleplate (3) made of low-silicon aluminum and secured to the pressing iron body portion (1) in a heat-conducting relationship thereto, wherein the soleplate (3) includes a coating (7) containing at least one of nickel and chromium, said coating applied by electrodeposition to the soleplate (3) to a thickness exceeding 40 μm, said coating being structured to increase progressively in hardness outwardly towards the ironing side of the aluminum soleplate (3).

2. The electric pressing iron as claimed claim 1, wherein the coating (7) comprises a first layer (8) with a thickness of 10 to 70 μm and a second layer (9) with a thickness of 10 to 70 μm.

3. The electric pressing iron as claimed in claim 2, wherein the coating comprises a third layer with a thickness of 10 to 50 μm.

4. The electric pressing iron as claimed in claim 2, wherein the first layer has a thickness of 50 μm.

5. The electric pressing iron as claimed in claim 2, wherein the second layer has a thickness of 50 μm.

6. The electric pressing iron as claimed in claim 3, wherein the third layer has a thickness of 20 μm.

7. The electric pressing iron as claimed in claim 1, wherein the coating (7) has an overall thickness of more than 60 μm.

8. The electric pressing iron as claimed in claim 1, wherein the coating comprises one or several layers each of which is made of a material selected from the group consisting of pure nickel, chromium, a chromium alloy with at least one of sulfur, phosphorus, cobalt, iron, sulfur with iron and sulfur with tungsten, and a nickel alloy with at least one of sulfur, phosphorus, cobalt, iron, sulfur with iron and sulfur with tungsten.

9. The electric pressing iron as claimed in claim 2, wherein the coating (7) comprises a first layer (8) of pure nickel and a second layer (9) of a nickel alloy, and a third layer (10) of chromium.

10. The electric pressing iron as claimed in claim 9, wherein the hardness of an outermost layer of the coating (7) is between 700 dphn and 1,100 dphn.

11. The electric pressing iron as claimed in claim 10, wherein the outermost layer of the coating is made of chromium.

12. The electric pressing iron as claimed in claim 3, wherein the second layer of the coating is made of a nickel-sulfur compound.

13. The electric pressing iron as claimed in claim 9, wherein the third layer of the coating is an outermost layer.

14. The electric pressing iron as claimed in claim 1 wherein the coating (7) comprises a first layer (8) with a hardness at least as great as 150 dphn, a second layer with a hardness of at least as great as 350 dphn, and a third layer with a hardness of at least as great as 550 dphn, the hardness of the soleplate (3) thus increasing progressively from the aluminum base material towards the outside.

15. The electric pressing iron as claimed in claim 14, wherein third layer has a hardness of 800 dphn.

16. A method of manufacturing an electric pressing iron in which a pressing iron portion of a silicon containing aluminum is cast integrally with an electric heating unit, with a soleplate of low silicon aluminum being secured to the body portion in good heat conducting relationship thereto, said method comprising electrolytically coating the soleplate, said coating comprising at least one of nickel and chromium said coating having a thickness of more than 40 $\mu$m and being structured such that the hardness of the soleplate increases progressively from the uncoated aluminum side towards the outside.

17. The method as claimed in claim 16, wherein the coating is nickel and the step of electrolytically coating comprises using an electrolytic bath and said method further comprises positioning a non-conductive screen in front of the soleplate in the electrolyte bath in order to obtain a uniform thickness of the metal deposit.

18. The method as claimed in claim 16, wherein the coating is chromium, the electrolytic coating step comprises using and electrolytic bath and wherein said method further comprises positioning a shaped anode conforming to the shape of the soleplate, and said anode is positioned in such a manner that a layer of essentially homogeneous thickness is deposited.

* * * * *